US006283611B1

(12) United States Patent
Sharrah et al.

(10) Patent No.: US 6,283,611 B1
(45) Date of Patent: Sep. 4, 2001

(54) FLASHLIGHT HAVING A SWITCH AND AN INTEGRALLY MOLDED MEMBER, AND METHOD FOR PRODUCING SAME

(75) Inventors: Raymond L. Sharrah, Collegeville; Charles W. Craft, Lansdale, both of PA (US)

(73) Assignee: Streamlight, Inc, Norristown, PA (US)

( * ) Notice: Subject to any disclaimer, the term of this patent is extended or adjusted under 35 U.S.C. 154(b) by 0 days.

(21) Appl. No.: 09/323,727

(22) Filed: Jun. 1, 1999

Related U.S. Application Data

(60) Provisional application No. 60/126,251, filed on Mar. 25, 1999.

(51) Int. Cl.[7] ..... F21L 4/04

(52) U.S. Cl. ..... 362/205; 362/202; 362/204; 362/206; 362/186; 362/189; 362/158

(58) Field of Search ..... 362/202, 204, 362/205, 189, 186, 158

(56) References Cited

U.S. PATENT DOCUMENTS

| | | | | |
|---|---|---|---|---|
| 4,429,351 | | 1/1984 | Petzl . | |
| 4,531,178 | | 7/1985 | Uke . | |
| 4,570,208 | * | 2/1986 | Sassmannshausen | 362/188 |
| 5,121,308 | | 6/1992 | Maglica . | |
| 5,267,487 | * | 12/1993 | Falco et al. | 74/558 |
| 5,309,337 | | 5/1994 | Groben . | |
| 5,345,370 | | 9/1994 | Murray . | |
| 5,404,281 | | 4/1995 | Parker . | |
| 5,551,323 | | 9/1996 | Beere . | |
| 5,590,951 | | 1/1997 | Matthews . | |
| 5,629,105 | | 5/1997 | Matthews . | |
| 5,642,932 | | 7/1997 | Matthews . | |
| 5,678,921 | * | 10/1997 | Kish et al. | 362/205 |
| 6,046,572 | | 4/2000 | Matthews . | |

OTHER PUBLICATIONS

Allied Signal Plastics/Advanced Elastomer Systems Brochure "Bond Flexibilty to Strength—Easily", USA: 1998.

DeGaspari, John, "Attraction Mating Hard & Soft Materials Takes the Right Chemistry", www.plasticstechnology.com, p 44–48, Jun. 1998.

Digiantonio, R.J., "True Precision Plastics", Advanced Elastomer Systems, Advanced Elastomer Systems Customer Report, "Reed Valve", Apr. 26, 1995.

Digiantonio, R.J., and G.K Lawrence, "Two–Shot Molding Of Thermoplastic Elastomers", Advanced Elastomer Systems, L.P., (included in Advanced Elastomer Systems Customer Report, "Reed Valve", Apr. 26, 1995).

Claypoole, H.L. "Jack", "Keynote Address", p. 7–12, (included in Advanced Elastomer Systems Customer Report, "Reed Valve", Apr. 26, 1995).

(List continued on next page.)

*Primary Examiner*—Sandra O'Shea
*Assistant Examiner*—Ali Alavi
(74) *Attorney, Agent, or Firm*—Dann, Dorfman, Herrell and Skillman, P.C.

(57) ABSTRACT

A flashlight is provided having a housing and a head. A molded member including a grip and an actuator button is molded into the housing as one piece to the housing of the flashlight to seal the flashlight and prevent infiltration of water, gases and small particles. Preferably, the materials of the housing and the molded member are selected of materials that form a chemical bond. Also preferably, the housing and molded member are formed by a two-step molding operation of a two-step molding machine. The actuator may be utilized to turn the flashlight on and off, is preferably located at the rear of the flashlight, and has a limited travel distance to preclude the actuator button from turning the flashlight on under certain conditions. In addition, the head of the flashlight is movable with respect to the housing to turn the flashlight continuously on and continuously off.

44 Claims, 7 Drawing Sheets

OTHER PUBLICATIONS

"Co–Injection Molding Of Elastomers", Advanced Elastomer Systems, (included in Advanced Elastomer Systems Customer Report, "Reed Valve", Apr. 26, 1995).
Advanced Elastomer Systems Brochure, "Grips", 1996.
Advanced Elastomer Systems Brochure, "Introducing The First Thermoplastic Vulcanizates That Bond To Nylon 6", 1996.

* cited by examiner

FLASHLIGHT HAVING A SWITCH AND AN INTEGRALLY MOLDED MEMBER, AND METHOD FOR PRODUCING SAME

This Application claims the benefit of U.S. Provisional Patent Application Ser. No. 60/126,251 filed Mar. 25, 1999.

FIELD OF THE INVENTION

The present invention relates to a flashlight and more specifically to a flashlight having a switch and having a member integrally molded to a housing of the flashlight.

BACKGROUND OF THE INVENTION

Flashlights have been used in industrial and underwater environments for many years. Conventional industrial flashlights and underwater flashlights utilize waterproof plastic covers and include control switches operated through a flexible seal that seals the flashlight against entry of water, gases and small hazardous particles. The waterproof plastic covers are slip-on covers that are molded in a separate operation from fabrication of the housing of the flashlight, and are later slipped onto the housing. Frequently, the plastic covers and the flexible seals, which are separate from the covers, tend to wear and leak with age and use, and are easily damaged in certain industrial and underwater settings.

Additionally, divers and industrial users of flashlights often carry heavy equipment and wear bulky protective clothing. Further, such users may be in small spaces with poor lighting and poor visibility. All of these conditions tend to impair the user's mobility and dexterity. Conventional flashlights with conventional waterproof plastic covers also tend to become slippery and difficult to handle.

Moreover, in usage in a high pressure environment such as in diving, a conventional flashlight momentary actuator switch is pressed against by the pressure of the water and will actuate when taken below a certain depth. Thus, the flashlight turns on and remains on whether or not the diver wants it on. To avoid this problem by increasing the force necessary to actuate the momentary switch is not satisfactory because the necessary actuation force would have to be too great for convenient actuation. In fact, people who do not have very strong fingers are likely to be unable to operate such high-actuation-force momentary switch.

Therefore, it is highly desirable to provide a flashlight with a grip and an actuator seal, through which is operated a switch, molded contemporaneously as one piece to the housing of the flashlight to seal the flashlight, for example, against entry of water, gases, small particles and other contaminants. It is also desirable to provide a flashlight having a momentary switch that does not actuate under the force of external pressure.

SUMMARY OF THE INVENTION

In accordance with an aspect of the present invention, a flashlight is provided having a housing which has a front end, a rear end, and a wall. A molded member is molded into the housing to provide a gripping surface and an actuator for operating a switch. The gripping surface and the actuator are molded to the housing as one piece.

In accordance with another aspect of the present invention, a flashlight is provided having a housing and a bulb and a switch connected in circuit in the housing. An actuator in the housing operates the switch, wherein the actuator and the housing include respective cooperating engaging features to limit the travel of the actuator relative to the housing.

BRIEF DESCRIPTION OF THE DRAWING

The foregoing summary, as well as the following detailed description of the preferred embodiments of the present invention, will be better understood when read in conjunction with the appended drawing, in which.

DETAILED DESCRIPTION OF THE PREFERRED EMBODIMENTS

Figure 1A:
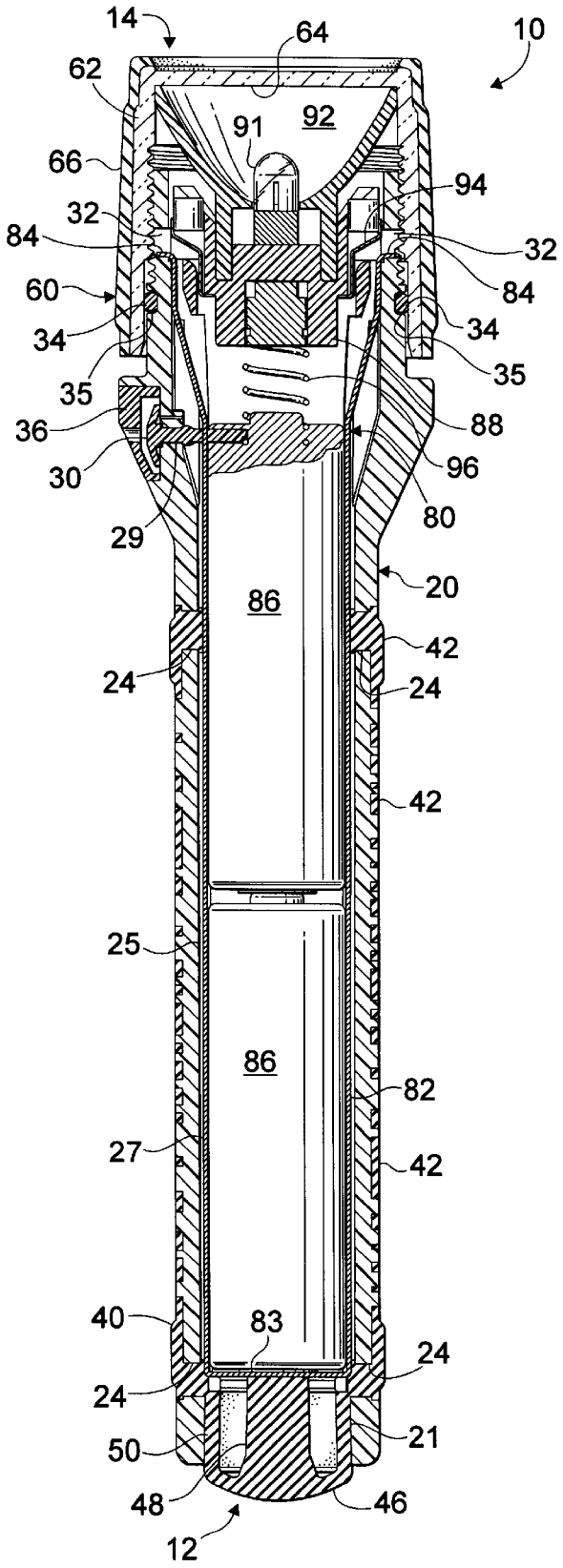
FIGS. 1A and 1B are side and perspective cross-sectional views, respectively, of an exemplary embodiment of a flashlight in accordance with the present invention, having a molded member including a grip and an actuator at a rear end of the flashlight.
Figure 1B:
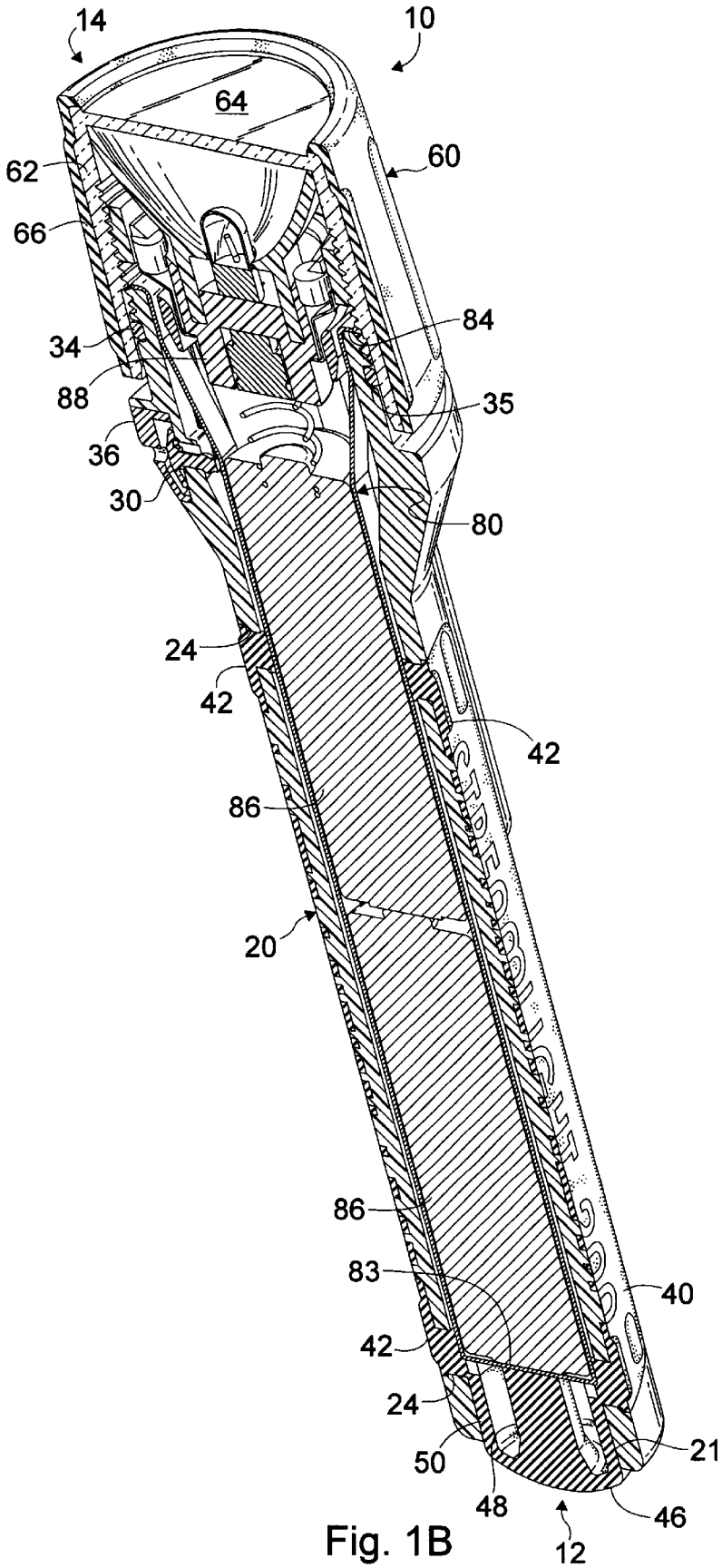
Figure 2:
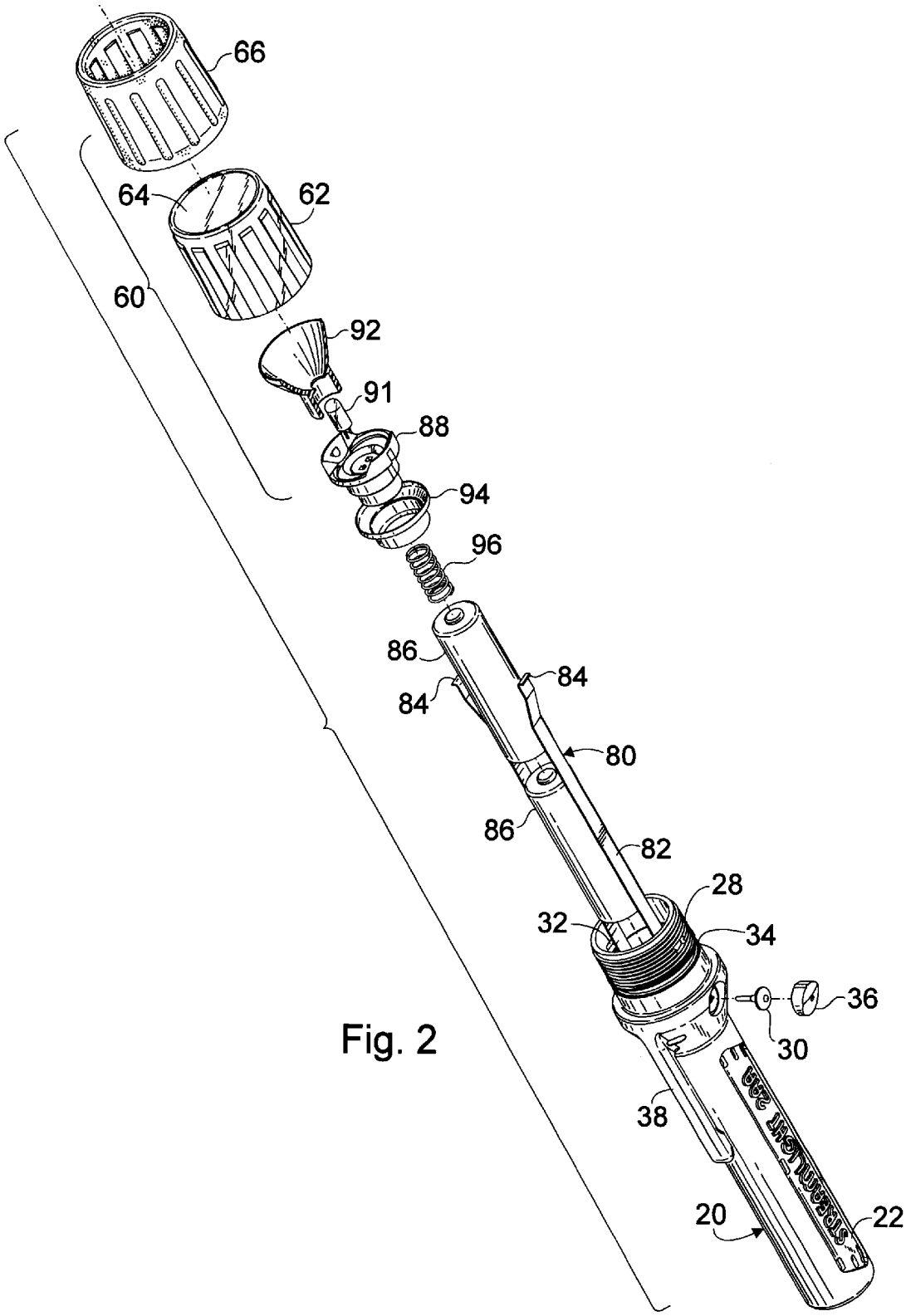
FIG. 2 is an exploded perspective view of the flashlight of FIGS. 1A and 1B, but without the molded member.

Referring now to the drawings in general, and principally to FIGS. 1A and 1B, flashlight 10 includes a housing 20 which holds batteries 86 and includes molded member 40, and a head 60 which includes a reflector 92 and a lamp or bulb 91. Molded member 40 is molded as one piece into the housing 20 of the flashlight 10 to contemporaneously form switch actuator button (or actuator) 46 and grip 42. Because molded member 40 including actuator button 46 and grip 42 is molded into housing 20 as one piece and adheres thereto, flashlight 10 is sealed to prevent infiltration by water, gases, small particles and other contaminants.

Flashlight 10 has a momentary switch function which utilizes switch actuator button 46 at a rear or tail end 12 of the flashlight 10, which actuator button 46 can be depressed to cause an electrical circuit including batteries 86 and bulb 91 to be completed to turn flashlight 10 on and which is released to break the circuit to turn lamp or bulb 91 and flashlight 10 off. A continuous action switch function is activated by twisting or rotating head 60 of the flashlight 10 relative to housing 20. Head 60 is rotated in one direction (e.g., clockwise, for right-hand threads) to likewise complete the circuit including batteries 86 and lamp or bulb 91 and in the opposite direction (e.g., counterclockwise)to break the circuit, thereby turning flashlight 10 on and off. Head 60 can be rotated further in the opposite direction to prevent flashlight 10 from being turned on in response to depressing momentary switch actuator button 46.

Referring to FIGS. 1A through 3, the housing 20 is generally cylindrical. The housing 20 is closed at the rear or tail end 12 of flashlight 10 by the actuator button 46 and is closed at the front or head end 14 by the head 60 of the flashlight 10.

The housing 20 is configured to have a generally hollow cylindrical interior to hold one or more batteries 86. In the preferred embodiments, the flashlight 10 holds a plurality of batteries 86 in series arrangement, which batteries may be, for example, one or more AA-size cells or C-size cells or D-size cells of the alkaline, nickel-cadmium, lithium or other suitable type. In the exemplary flashlight 10, for example, two AA-size alkaline cells (as shown) or three C-size alkaline cells are employed. A generally U-shaped elongated actuator (or actuator member) 80 fits within the housing 20 with its elongated sides 82 in longitudinal grooves 27 located in wall 26 on opposite sides of the batteries 86 and its short base or end 83 located across the rear end of the rearward-most battery 86. In flashlight 10, it is preferred that U-shaped elongated actuator 80 be formed of an electrically conductive material, for example, copper, brass, beryllium copper, stainless steel or other suitable conductive material, so as to provide an electrical contact with a rearward terminal of rearmost battery 86. Outwardly extending contact arms 84 at the upper ends of elongated sides 82 of elongated actuator 80 are positioned within slots 32 formed in the threaded portion 28 of the housing 20. Slots 32 are preferably about ⅛-inch long for allowing contact arms 84 of elongated actuator 80 to move axially within housing 20 over a limited range of travel, i.e. about ⅛ inch, and to make contact with contact holder 94 for completing the electrical circuit of batteries 86 and bulb 91 when actuator button 46 is pressed, thereby activating the momentary switch function.

Head 60 includes a cylindrical inner head member 62 including lens 64. Threads on the inside of the inner head member 62 engage matching threads on a threaded portion 28 of the housing 20 for securing the head 60 onto the housing 20 and for allowing the head 60 to be rotatable relative to the housing 20 for turning the flashlight on and off. An O-ring seal 34 is located in a circumferential groove 35 on the outside of housing 20 rearward of the threaded portion 28 thereof. O-ring 34 is pressed between the inner head member 62 and the housing 20 to provide a fluid-tight seal therebetween. An outer cylindrical head member 66 overlies inner head member 62, and is preferably formed by molding a rubber or elastomeric material over inner head member 62.

A reflector 92, preferably parabolic or near-parabolic in shape, forms light produced by bulb 91 into a beam that is directed through lens 64 and out the front end 14 of flashlight 10. A bulb holder 88 of insulating material is located in a cylindrical recess in the rearward end of reflector 92 within head 60 and holds a bulb 91, preferably a gas-filled bi-pin lamp, in proper position with respect to reflector 92. The rearward end of bulb holder 88 includes a conical surface and two cylindrical portions of different diameter, in that order. An electrically-conductive contact holder 94 includes a conical section and a cylindrical section that fit and are attached to the conical surface and the larger cylindrical surface, respectively, of bulb holder 88. Contact holder 94 includes a conical conductive plate that is in electrical contact with one lead of bulb 91. An electrically-conductive spring 96 resides within a recess in the rearward end of the smaller-diameter cylindrical portion of bulb holder 88 wherein it is in electrical contact with the second lead of bulb 91. Spring 96 extends rearward within the housing 20 to establish electrical contact between the second lead of bulb 91 and the forward terminal of forward-most battery 86. Spring 96 is in compression and urges bulb holder 88, reflector 92 and contact holder 94 forward toward the front end 14 of flashlight 10 and urges elongated actuator 80 and batteries 86 rearward toward the rear end 12 of the flashlight 10 whereby contact arms 84 are at the rearward end of slots 32. As a result, elongated actuator 80 and contact arms 84 are moved away from the contact holder 94 to break the electrical circuit, thereby disconnecting the bulb 91 from the batteries 86. This is the "off" condition.

Operation of the continuous switch function for continuous illumination of bulb 91 is as follows. To turn flashlight 10 on, head 60 is screwed further onto housing 20, i.e. so that it moves axially rearward on housing 20, to move contact holder 94 rearward until it contacts switch arms 84 to complete the electrical circuit including batteries 86 and bulb 91 which thus produces light. To turn flashlight 10 off, head 60 is unscrewed slightly, i.e. so that it moves axially forward on housing 20, to move contact with holder 94 forward until it breaks contact with switch arms 84 to break the electrical circuit including batteries 86 and bulb 91 which thus ceases to produce light. Head 60 is unscrewed enough to break the electrical circuit, e.g., between about ½ and 1 turn from bottom, but not so much as to break the seal of O-ring 34 between head 60 and housing 20. In this condition, the momentary switch function is operable or the flashlight 10 may be again continuously turned on by again screwing head 60 further onto housing 20.

Operation of the momentary switch function for momentary illumination of bulb 91 is as follows. With head 60 unscrewed sufficiently to break electrical contact between contact holder 94 and contact arms 84 of elongated actuator 80, actuator button 46 is pressed to press actuator plug or stem 48 against the base 83 of elongated actuator 80 to move elongated actuator 80 axially forward until contact arms 84 thereof moving within slots 32, most easily seen in FIG. 3, make contact with contact holder 94 to complete the electrical circuit including batteries 86 and bulb 91 which thus produces light. Releasing actuator button 46 allows spring 96 to move batteries 86 and elongated actuator 80 axially rearward, thereby breaking the contact between contact arms 84 of elongated actuator 80 and contact holder 94 to break the circuit and extinguish bulb 91. The momentary switch function is operable when head 60 is unscrewed enough to break the electrical circuit but not so much as to preclude contact arms 84 from contacting contact holder 94 when contact arms are at the forward-most ends of slots 32, e.g., between about ½–1 turn and 2–2½turns from bottom, but not so much as to break the seal of O-ring 34 between head 60 and housing 20.

Flashlight 10 may be rendered unresponsive to actuator button 46, as is desirable in diving usage, for example, by further unscrewing head 60 sufficiently to preclude the electrical circuit formed by contact arms 84 contacting contact holder 94 from being completed, e.g., more than about 2–2½ turns from bottom, but not so much as to break the seal of O-ring 34 between head 60 and housing 20, e.g., more than about 4–5 turns from bottom In this condition, flashlight 10 cannot be turned on without first screwing head 10 further onto housing 20.

This condition is a desirable feature where differential pressure conditions between the interior of flashlight 10 and its external environment, such as when the flashlight is used underwater at significant depths, may press on actuator button 46 sufficiently to move elongated actuator 80 and the batteries 86 forward causing contact arms 84 to travel forward within the slots 32 and make contact with the contact holder 94 to turn on bulb 91. This undesirable result caused by high underwater external pressure, is avoided by rotating or unscrewing the head 60 of the flashlight 10 sufficiently to move contact holder 94 axially forward beyond the forward ends of slots 32 so that the contact arms 84, whose travel is limited by the length of slots 32, can no longer make contact with the contact holder 94. In this position, even if the contact arms 84 travel forward due to external pressure upon the actuator button 46, contact arms 84 are confined within slots 32 in housing 20 and so can not make contact with contact holder 94.

Thus, because the axial travel of elongated actuator 80 is positively limited by cooperating physical features on elongated actuator 80 and on housing 20, actuator button 46 can be effectively rendered inoperative so as to prevent flashlight 10 from turning on due to external pressure on actuator button 46.

An aperture 29 through the wall of the housing 20 is provided for receiving in a narrow portion thereof an elastomeric pressure relief valve 30 that is to release any pressure build up in the sealed flashlight 10, such as might be caused by generation of gas by batteries 86, while maintaining a seal against the inflow of water, gas, small particles, or other contaminants. Elastomeric valve 30 is protected by valve cover 36 which is inserted into a widened portion of aperture 29. In addition, housing 20 includes for convenience a pocket clip or belt clip 38 for attaching the flashlight 10 in the user's pocket or to the user's belt.

As may be seen in FIGS. 1A and 1B, molded member 40 is molded into housing 20. Molded member 40 includes a grip portion 42 and an actuator portion 46. Grip portion 42 adheres to housing 20 and forms a seal for openings 24 therein. Actuator button 46 is comprised of a central cylindrical plug or stem 48 for engaging and moving elongated actuator 80 when actuator button 46 is pressed and an outer cylindrical skirt 50 that adheres to the interior surface of opening 21 of housing 20 to form a seal therewith.

Figure 3:
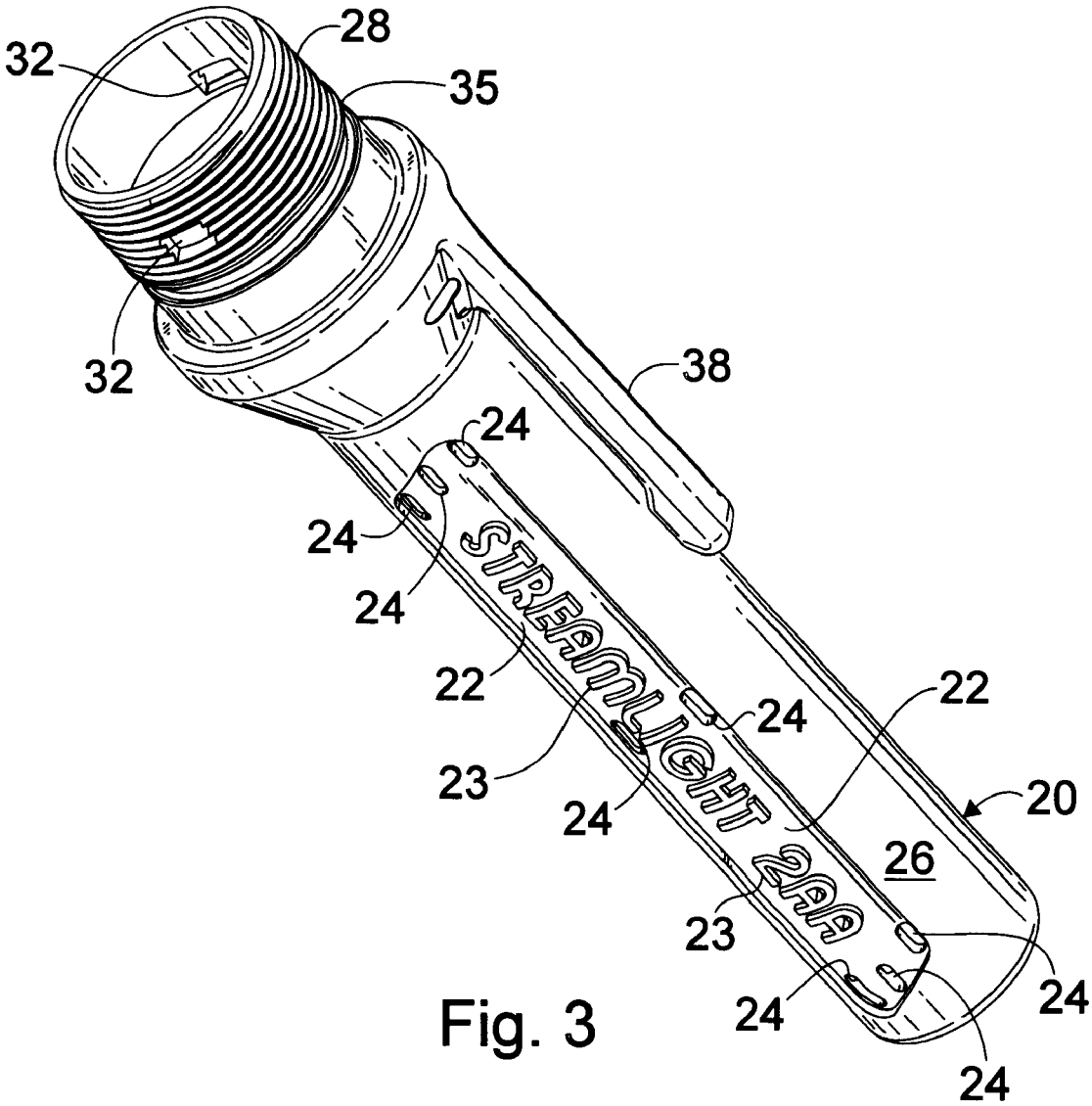
FIG. 3 is a perspective view of the housing of the flashlight of FIGS. 1A and 1B, but without the molded member.
Figure 4:
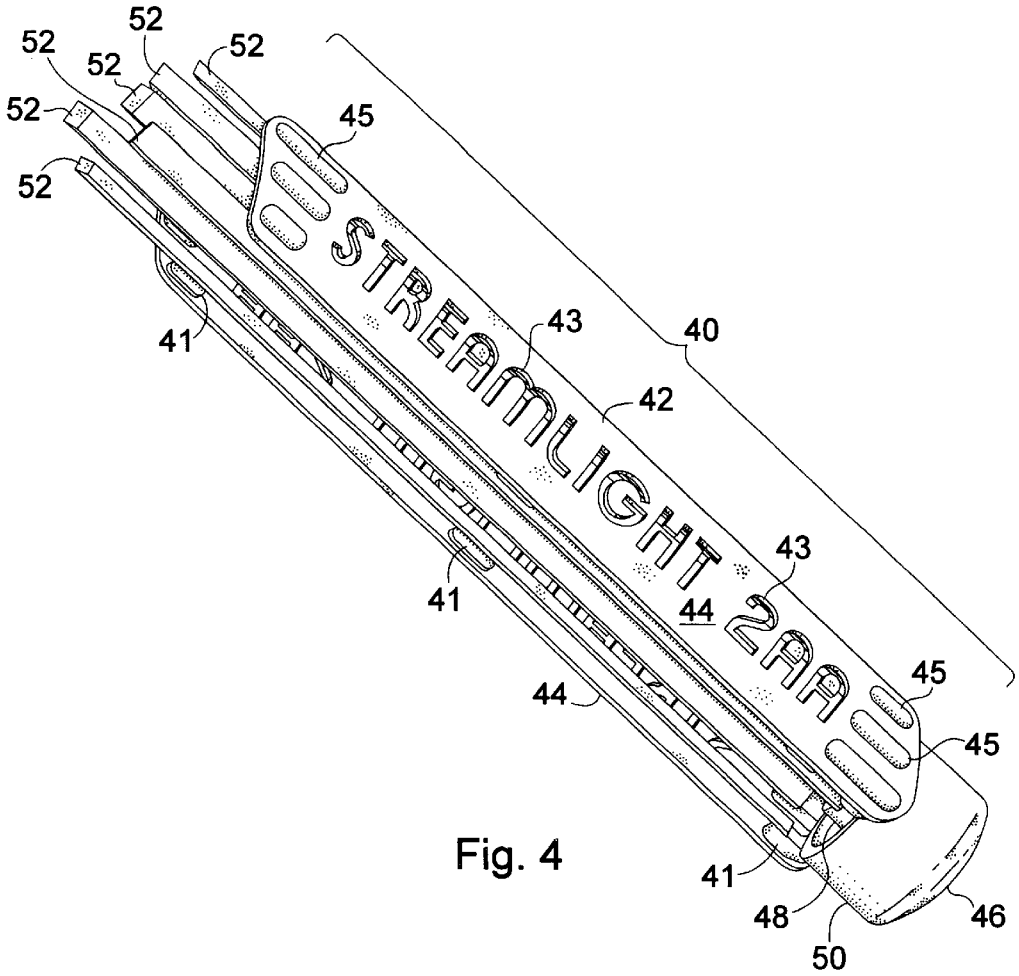
FIG. 4 is a perspective view of the molded member of the flashlight of FIGS. 1A and 1B apart from the housing thereof.

Referring to FIGS. 3 and 4, housing 20 includes one or more cavities in the exterior thereof, such as longitudinal cavities 22, each communicating with one or more openings 24 through the wall of the housing 20 through which a thermoplastic elastomer flows when injected to form molded member 40, shown apart from housing 20 in FIG. 4. Molded member 40 preferably comprises two side panels 44 that reside in corresponding cavities 22 of housing 20 to serve as gripping surfaces 42 of flashlight 10 and an actuator button 46 that resides in the rear end of housing 20 that serves to actuate a switch function, all of which is molded contemporaneously as one piece into the housing 20. Elastomeric material forming molded member 40 is preferably injected at cylindrical opening 21 at the rear end of housing 20 to form actuator button 46 and flows through passages described below, such as openings 24, to form grip 42. Grip 42 preferably includes raised features such as bumps 45 to facilitate a surer grip and/or to enhance the appearance of flashlight 10.

Figure 5:
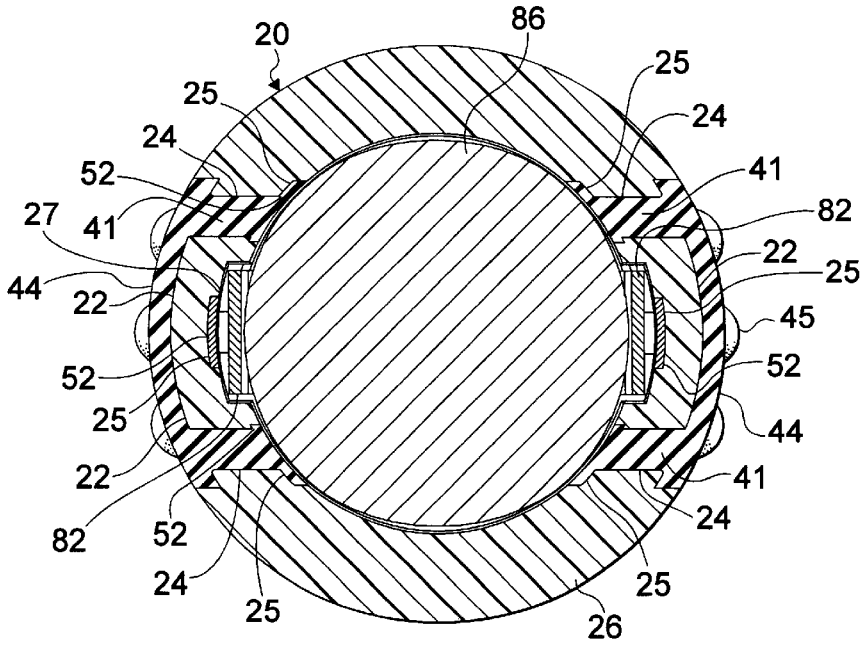
FIG. 5 is a transverse cross-sectional view of the flashlight of FIGS. 1A and 1B including the molded member.

The arrangement of flashlight 10 is also shown in the cross-sectional view of FIG. 5. Unitary molded member 40 includes longitudinal portions 52 filling optional longitudinal grooves 25, plugs 41 filling holes 24 and side panels 44 filling cavities 22 in the wall 26 of housing 20. Elongated sides 82 of elongated actuator 80 are located in the longitudinal grooves 27 in the wall 26 on both sides of batteries 86 located in the central cavity of housing 20.

Preferably, housing 20 is an injection molded piece and molded member 40 is injection molded therein. Further, a two-step injection molding process is preferably utilized to form housing 20 and to mold molded member 40 therein, and preferably on a single molding machine known as a "two-step" or "two-shot" molding machine. The two step injection molding process can employ an injection molding machine having two independently operable injection units, each of which injects a different material. The machine includes first and second sets of passages or "runner systems" through which the two different molding materials flow, and the runner systems can be independently connected and disconnected, for example, by valves.

In the first step of molding housing 20, the housing 20 is formed utilizing a first mold having an internal core defining the interior shape of housing 20 and having an external mold defining the shape of the exterior of housing 20, as illustrated in FIG. 3, for example. The exterior mold defines a generally cylindrical cavity and has inward projections defining the cavities 22, openings 21 and 24, aperture 29 and other external features of housing 20. The internal core is generally cylindrical and has outward projections defining longitudinal grooves 25 and 27 and other internal features of housing 20.

Heated thermoplastic substrate material is injected into the closed first mold through a primary runner system, as in a normal injection molding cycle. During the first injection, the machine passages and runner system through which the thermoplastic elastomer of which molded member 40 including grip 42 and actuator button 46 are formed are shut off from the primary runner system. After the substrate material of housing 20 cools, the external mold and the internal core are removed and the molded housing 20 remains. The molded housing 20 has a number of longitudinal grooves or passages 25, 27 on the inside of the housing 20 and has openings 24 through the wall 26 of housing 20 through which and into which the elastomer for the grip 42 and the actuator button 46 will flow. Additionally, the housing 20 has cavities 22 on the exterior wall 26 of the housing 20 through which the elastomer for molded member 40 will flow and which the elastomer will fill. Cavities 22 are formed with a small raised rim or lip along the edges thereof on the outer surface of housing 20, which lip is crushed by the second exterior mold halves to form a tight seal therebetween during the injection molding of the elastomer described below. For smaller diameter housings 20, optional grooves 25 may be omitted leaving openings 24 at the rearward end of housing 20 in fluid communication between cylindrical opening 21 and cavity 22 and openings 24 proximate the head end of housing 20 to serve as vents when the elastomeric material is injected.

In the second step, a second exterior mold defining the exterior shape of molded member 40 and otherwise generally conforming to the shape of housing 20 is placed over housing 20. A second internal core having a diameter slightly smaller than the inside diameter of housing 20, but not having features corresponding to longitudinal grooves 25 therein, is inserted into the interior of housing 20. The second internal core includes features defining cylindrical stem 48 and cylindrical skirt 50 of actuator button 46. The first runner system of the molding machine is disconnected and the second runner system is connected to the mold volume to be filled with thermoplastic elastomer to form molded member 40. The mold volume defined by the second exterior mold and the second internal core includes opening 21, actuator button 46, optional grooves 25, openings 24 and cavities 22 which are all in fluid communication. Heated thermoplastic elastomer is injected, for example, at opening 21 at the rear end 12 of housing 20 and flows through openings 21 and 24, optional grooves 25 and cavities 22 to fill the mold volume to form plug 48, skirt 50, actuator button 46 and grip 42 of molded member 40 contemporaneously as one piece. Where optional grooves 25 are omitted, excess thermoplastic is preferably vented through the openings 24 proximate the head end of housing 20.

The molded member 40 so formed is shown apart from housing 20 in FIG. 4. After sufficient curing of the thermoplastic elastomer by cooling, the second exterior mold and the second interior core are removed, and the housing 20 with the molded insert 40 formed therein is ejected. This process enables the grip 42 and actuator button 46 to be integrally formed in the housing 20 and to adhere thereto to form a rugged and permanent seal, thereby avoiding the leakage problems of prior art flashlights. It is noted that optional grooves 25, openings 24 and cavities 22 are completely filled as illustrated by elongated elements 52, plugs 41 and side panels 44, respectively, and that opening 21 is partially filled by plug 48 and skirt 50 of actuator button 46, all of which are formed with elastomeric material that preferably adheres to or bonds with the substrate material of housing 20 to form a seal therewith.

Optionally, portions 23 of the housing 20 may be formed so as to be visible through elastomeric grip 42 for aesthetic or commercial purposes. As also shown in FIGS. 3 and 4, raised indicia such as characters 23 formed in the housing 20, for example, letters spelling the manufacturers name, "STREAMLIGHT" in this example, project through openings 43 in molded member 40 to be substantially even with the exposed surface thereof and so are visible. Other features, designs, logos and the like may also be made to remain visible after molded member 40 is molded in place, and may be decorative or may communicate information such as safety information, warnings, product information, logos and designs, as may be desirable, and the materials selected for the substrate material and the elastomeric material may be of colors chosen for communicative or aesthetic purposes.

The combination of materials for housing 20 and molded insert 40 are preferably selected so that molded insert 40 is "molecularly bonded" or "chemically bonded" to housing 20, thereby to from a permanent and rugged seal. In addition, it is also desirable that the material of which housing 20 is formed be structurally strong while the material of which molded member 40 is formed be soft and flexible to facilitate easy movement of actuator button 46 and provide a non-slip grip 42. The housing 20 is a preferably a thermoplastic nylon such as that available from Allied Signal, Inc., Engineering Plastics, located in Morristown, N.J., and sold under the trademarks CAPRON® and NYPEL®. Additionally, the housing 20 can be formed of polypropylene, polycarbonate, polyester-polycarbonate blends and ABS polycarbonate blends (such as LEXAN® polycarbonate, XENOY polyester-polycarbonate blend and CYCALOY ABS polycarbonate blend, all of which are available from the General Electric Company, GE Plastics) or Nylon 6.

Molded insert 40 is preferably formed of a thermoplastic elastomer (TPE) such as MONOPRENE® rubber available from Quality Service Technology located in St. Albans, Vt. or of a TPE or thermoplastic vulcanizate (TPV) such as nylon-bondable SANTOPRENE rubber available from Advanced Elastomer Systems located in Akron, Ohio, or HERCUPRENE rubber available from JVON NA located in Litchfield, Mass. SANTOPRENE rubber, for example, chemically bonds to nylon 6, glass-reinforced nylon 6 and blends of nylon 6 and nylon 6/6 without requiring a primer that would complicate the two-step molding process.

A two-step injection molding process, similar to the process used to form housing 20 and molded member 40, is preferably utilized to bond an outer head cap member 66 to the inner head member 62 of head 60 of flashlight 10. In the first molding step, the inner head member 62 including lens 64 are formed as one piece utilizing a mold having an internal core and an exterior mold that define the shape and features, such as the internal threads, thereof. Transparent thermoplastic substrate material is injected through a primary runner system, as in a normal injection molding cycle, and the mold volume and passages of the second runner system to be utilized to inject the thermoplastic elastomer for the outer head member 66 are shut off from the primary runner system. After the inner head member 62 including lens 64 is allowed to cool, the external mold and the internal core are removed and the one piece molded head 62 including lens 64 remains.

In the second molding step, an exterior mold defining the shape and features of outer head member 66 is closed over inner head member 62 and the second runner system is connected to the volume to be filled. Thermoplastic elastomer is injected into the mold over-forming the outer head member 66 directly onto the inner head member 62. The outer head member 66 is molded around the head 62 only and not on lens 64. After sufficient cooling of the thermoplastic elastomer, the exterior mold is removed, and the inner head member 62 with the outer head member 66 formed thereon is removed. This process enables the outer member 66, which is preferably formed of a material providing a gripping surface, to be integrally formed around the inner head member 62. The combination of materials for the outer head grip 66 and the inner head member 62 are similar to the combination of materials used for housing 20 and molded member 40, thereby to allow for the molecular bonding of the outer head grip 66 around and to inner head member 62, and preferably for a softer, easier to grip head grip 66 and a structurally strong inner head member 62.

Preferably, both molding steps in forming inner head member 62 and outer head grip 66 of head 60 are performed sequentially on a two-step or two-shot molding machine.

Figure 6:
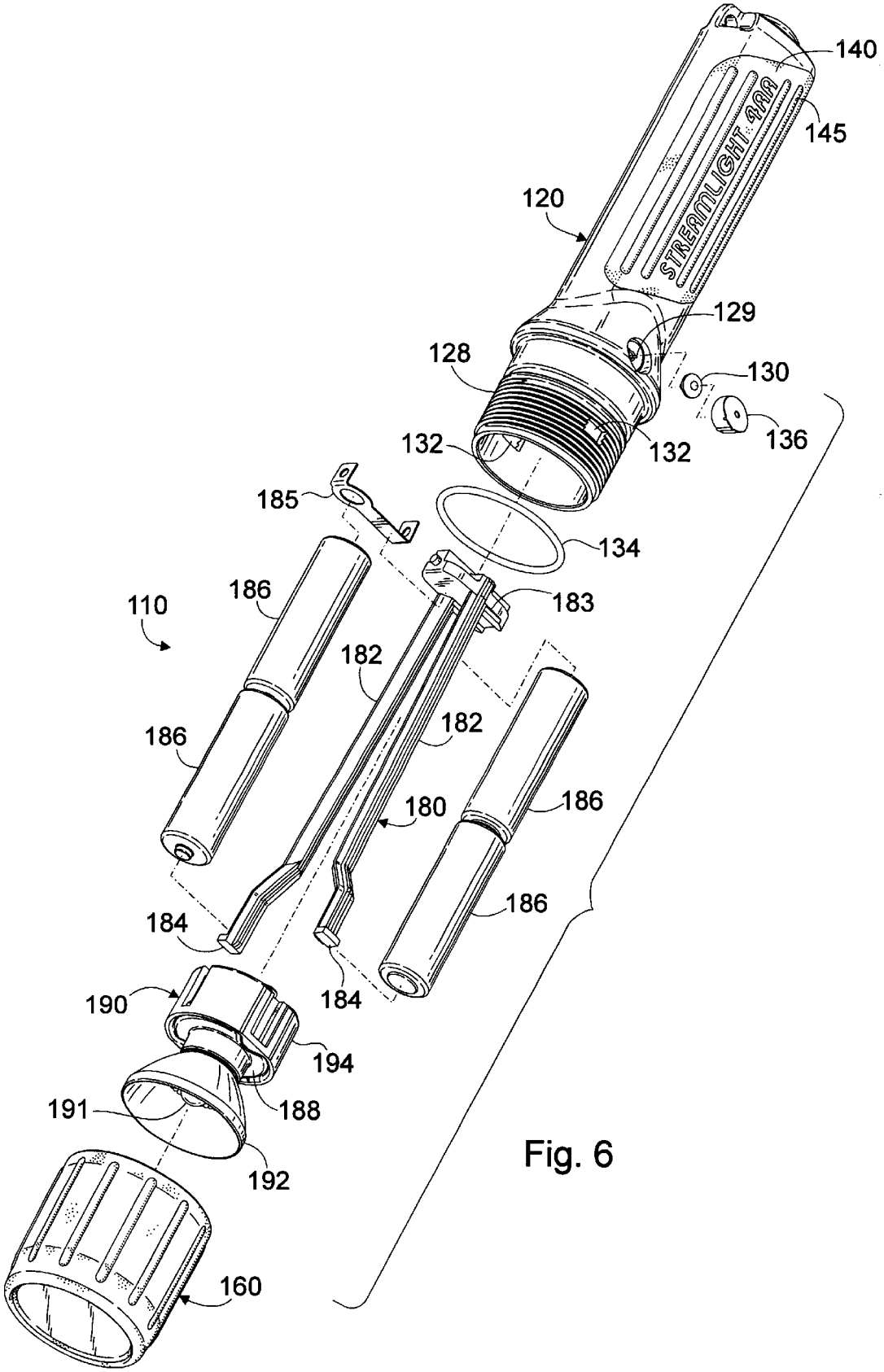
FIG. 6 is an exploded perspective view of an alternative embodiment of a flashlight in accordance with the present invention.
Figure 7:
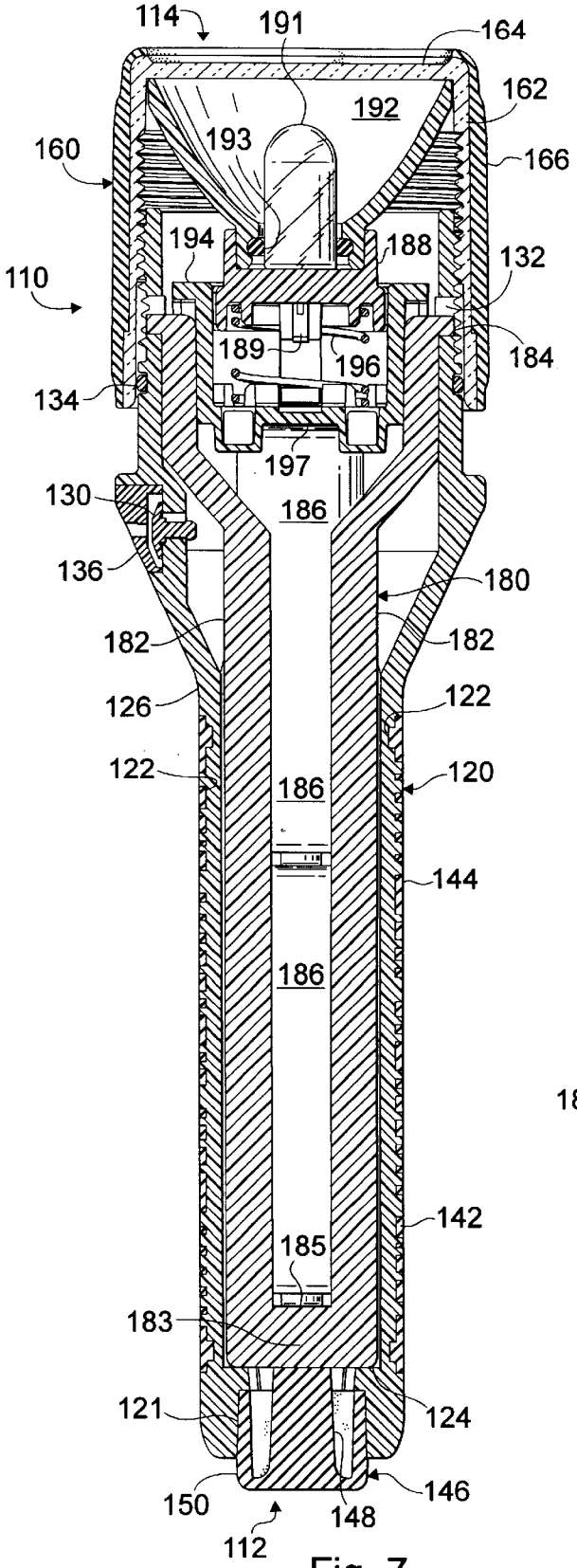
FIG. 7 is a cross-sectional view of the flashlight of FIG. 6.
Figure 8:
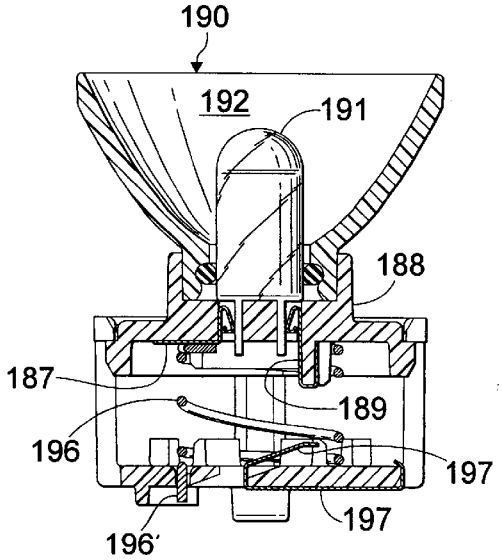
FIG. 8 is a cross-sectional view of part of the head of the flashlight of FIG. 6.

Referring now to FIGS. 6, 7 and 8, in which items designated by numerical designations "1xx" generally correspond to items designated "xx" in FIGS. 1A through 4, flashlight 110 includes a housing 120 which holds four AA-size batteries 186 and includes molded member 140, and a head 160 which includes a reflector 192 and a lamp or bulb 191. Molded member 140 is molded as one piece into the housing 120 of the flashlight 110 to contemporaneously form switch actuator button 146 and grip 142. Because molded member 140 including actuator button 146 and grip 142 is molded into housing 120 as one piece and adheres thereto, flashlight 110 is sealed to prevent infiltration by water, gases, small particles and other contaminants.

Flashlight 110 has a momentary switch function which utilizes switch actuator button 146 at a rear or tail end 112 of the flashlight 110, which actuator button 146 can be depressed to cause an electrical circuit including batteries 186 and bulb 91 to be completed to turn flashlight 110 on and which is released to break the circuit to turn bulb 91 and flashlight 110 off. A continuous action switch function is activated by twisting or rotating head 160 of the flashlight 110 relative to housing 120. Head 160 is rotated in one direction (e.g., clockwise, for right-hand threads) to likewise complete the circuit including batteries 186 and bulb 191 and in the opposite direction (e.g., counterclockwise) to break the circuit, thereby turning flashlight 110 on and off. Head 160 can be rotated further in the opposite direction to prevent flashlight 110 from being turned on in response to depressing momentary switch actuator button 146.

Housing 120 is generally oval shaped in cross-section and is closed at the rear or tail end 112 of flashlight 110 by the actuator button 146 and is closed at the front or head end 114 by the head 160 of the flashlight 110.

The housing 120 is configured to have a generally hollow oval-shaped interior to hold four AA-size batteries 186 in a two-long by two-wide arrangement. Batteries 186, which are electrically connected in series, may be, for example, of the alkaline, nickel-cadmium, lithium or other suitable type. A generally U-shaped elongated actuator (or actuator member) 180 fits within the housing 120 with its elongated sides 182 on opposite sides of the arrangement of four batteries 186 and its short base or end 183 located across the rearward ends of the two rearward-most batteries 186.

In flashlight 110, it is preferred that U-shaped elongated actuator 180 be molded of insulating material and provide actuation of electrical contacts in switch module 190 responsive to actuator button 146. Base 183 of actuator 180 has a bridging contact 185 thereon to provide an electrical connection between the rearward terminals of the two rearward-most batteries 186. Bridging contact 185 includes an annular portion for contacting to battery negative terminals and a narrow strip portion for connecting to battery positive terminals. Outwardly extending arms 184 at the upper ends of elongated sides 182 of elongated actuator 180 are positioned within slots 132 formed in the threaded portion 128 of the housing 120. Slots 132 are preferably about ⅛-inch long for allowing arms 184 of elongated actuator 180 to move axially within housing 120 over a limited range of travel, and to actuate switch contacts within switch module 190 for completing the electrical circuit of batteries 186 and bulb 191 when actuator button 146 is pressed, thereby activating the momentary switch function.

Head 160, best appreciated in the cross-sectional views of FIGS. 7 and 8 which are taken in planes rotated 90° from each other, includes a cylindrical inner head member 162 including lens 164. Threads on the inside of the inner head member 162 engage matching threads on a threaded portion 128 of the housing 120 for securing the head 160 onto the housing 120 and for allowing the head 160 to be rotatable relative to the housing 120 for turning the flashlight 110 on and off. An O-ring seal 134 is located in a circumferential groove 135 on the outside of housing 120 rearward of the threaded portion 128 thereof. O-ring 134 is pressed between the inner head member 162 and the housing 120 to provide a fluid-tight seal therebetween. An outer cylindrical head member 166 overlies inner head member 162, and is preferably formed by molding a rubber or elastomeric material over inner head member 162.

A parabolic or near-parabolic reflector 192 forms light produced by bulb 191 into a beam that is directed through lens 164 and out the front end 114 of flashlight 110. A bulb holder 188 of insulating material includes two cylindrical portions of different diameter and with two electrical contacts 187, 189 and O-ring 193 holds bulb 91, preferably a gas-filled bi-pin lamp, in proper position with respect to reflector 192. Bulb holder 188 has a smaller diameter hollow forward section positioned around a cylindrical projection from the rearward end of reflector 192 within head 160. A larger diameter generally flat rearward cylindrical end of bulb holder 188 is located and is movable axially within the interior of a hollow cylindrical contact holder 194. Bulb holder 188 includes on its rearward surface a central electrical contact 189 electrically connected to one lead of bulb 191 and a radially-extending conductor 187 electrically connected to the other lead of bulb 191.

Contact holder 194 is a hollow cylinder closed at its rearward end and is molded of an electrically-insulating material. Contact holder 194 includes plural retaining tabs or snaps that retain bulb holder 188 therein to form switch module 190. Contact holder 194 includes a battery contact 197 having an annular conductive contact on its rearward outer end located to be in electrical contact with the negative terminal of one of the forward-most batteries 186 and having a second contact centrally located on the interior end surface of contact holder 194. An electrically-conductive spring 196 resides within switch module 190 to bias bulb holder 188 forward with respect to contact holder 194. The forward end of spring 196 provides an electrical connection to bulb 191 via the radially-extending conductor 187 of bulb holder 188 and the rearward end 196' of spring 196 is bent to project axially through a hole in the rearward end of contact holder 194 to provide an electrical contact with the positive terminal of the other forward-most one of batteries 186. Spring 196 is in compression and urges bulb holder 188 and reflector 192 forward toward the front end 114 of flashlight 110 and urges contact holder 194, batteries 186 and elongated actuator 180 which is in contact therewith, rearward toward the rear end 112 of the flashlight 110. As a result, central contact 189 and battery contact 197 are spaced apart to break the electrical circuit, thereby disconnecting the bulb 191 from the batteries 186 and urging arms 184 toward the rearward ends of slots 132. This is the "off" condition of flashlight 110.

Operation of the continuous switch function for continuous illumination of bulb 191 is as follows. To turn flashlight 110 on, head 160 is screwed further onto housing 120, i.e. so that it moves axially rearward on housing 120, to move reflector 192 and bulb holder 188 rearward. Bulb holder 188 moves rearward within contact holder 194 until central contact 189 contacts battery contact 197 to complete the electrical circuit including batteries 186 and bulb 191 which thus produces light. To turn flashlight 110 off, head 160 is unscrewed slightly, i.e. so that it moves axially forward on housing 120, sufficiently to move bulb holder 188 forward until central contact 189 and battery contact 197 move apart to break the electrical circuit including batteries 186 and bulb 191 which thus ceases to produce light. When head 160 is unscrewed enough to break the electrical circuit, e.g., between about ½ and 1 turn from bottom, it does not move axially so much as to break the seal between head 160 and housing 120 provided by O-ring 134. In this condition, the momentary switch function is operable or the flashlight 110 may be again continuously turned on by screwing head 160 further onto housing 120.

Operation of the momentary switch function for momentary illumination of bulb 191 is as follows. With head 160 unscrewed sufficiently to break electrical contact between central contact 189 of bulb holder 188 and battery contact 197 of contact holder 194, actuator button 146 is pressed to press actuator plug or stem 148 against the base 183 of elongated actuator 180 to move elongated actuator 180 axially forward with arms 184 thereof moving forward within slots 132. Batteries 186 rest against base 183 of elongated actuator 180 and against contact holder 194 so that depressing actuator button 146 to move actuator 180 forward also moves batteries 186 and contact holder 194 forward. Moving contact holder 194 forward relative to bulb holder 188 causes central contact 189 and battery contact 197 to move together and to make contact to complete the electrical circuit including batteries 186 and bulb 191 which thus produces light. Releasing actuator button 46 allows spring 196 to move contact holder 194, batteries 186 and elongated actuator 180 axially rearward, thereby breaking the contact between central contact 189 and battery contact 197 to break the circuit and extinguish bulb 191. The momentary switch function is operable when head 160 is unscrewed enough to break the electrical circuit, but not so much as to preclude contact holder 194 from moving forward to the extent necessary to bring central contact 189 and battery contact 197 together. In other words, the distance of forward travel of contact holder 194 required to bring central contact 189 and battery contact 197 together is not so great as to bring arms 184 to the forward-most ends of slots 132. Typically, this momentary switch operation is possible when head 160 is unscrewed between about ½–1 and 2–2½ turns from bottom, but not so much as to break the seal between head 160 and housing 120 provided by O-ring 134.

Flashlight 110 may be rendered unresponsive to actuator button 46, as is desirable in diving usage, for example, by further unscrewing head 160 sufficiently to preclude the electrical circuit formed by central contact 189 contacting battery contact 197 from being completed, e.g., more than about 2–2½ turns from bottom, but not so much as to break the seal between head 160 and housing 120 provided by O-ring 134, e.g., more than about 4–5 turns from bottom In this condition, flashlight 110 cannot be turned on momentarily or otherwise without first screwing head 160 further onto housing 120.

This condition is a desirable feature where differential pressure conditions between the interior of flashlight 110 and its external environment, such as when the flashlight is used underwater at significant depths, may press on actuator button 146 sufficiently to move elongated actuator 180, batteries 186 and contact holder 194 forward causing battery contact 197 to travel forward within switch module 190 and make contact with the central contact 189 of bulb holder 188 to turn on bulb 191. This undesirable result caused by high underwater external pressure, is avoided by rotating or unscrewing the head 160 of the flashlight 110 sufficiently to move bulb holder 188 and central contact 189 thereof axially forward beyond the forward-most position to which battery contact 197 of contact holder 194 may be moved. This position is determined and is limited by movement of arms 184 to the forward-most ends of slots 132 so that the battery contact 197, whose travel is also limited by the length of slots 132, can no longer make contact with the contact 189. In this position of head 160, even if the arms 184 travel forward due to external pressure upon the actuator button 146, arms 184 are confined within slots 132 in housing 120 and so prevent the completion of the electrical circuit between contacts 189 and 197 within switch module 190.

Thus, because the axial travel of elongated actuator 180 is positively limited by cooperating physical features on elongated actuator 180 and on housing 120, actuator button 146 can be effectively rendered inoperative so as to prevent flashlight 110 from turning on due to pressure on actuator button 146.

An aperture 129 through the wall of the housing 120 is provided for receiving in a narrow portion of aperture 129 an elastomeric pressure relief valve 130 that is to release any pressure build up in the sealed flashlight 110, such as might be caused by generation of gas by batteries 186, while maintaining a seal against the inflow of water, gas, small particles, or other contaminants. Elastomeric valve 130 is protected by valve cover 136 which is inserted into a widened portion of aperture 129.

As may be seen in FIG. 7, molded member 140 is molded into housing 120. Molded member 140 includes a grip portion 142 and an actuator portion 146. Grip portion 142 adheres to housing 120 and forms a seal for openings 121 and 124 therein. Actuator button 146 is comprised of a central cylindrical plug or stem 148 for engaging and moving elongated actuator 180 when actuator button 146 is pressed and an outer cylindrical skirt 150 that adheres to the interior surface of opening 121 of housing 120 to form a seal therewith.

Housing 120 includes one or more cavities in the exterior thereof, such as longitudinal cavities 122, each in fluid communication with opening 121 via one or more openings 124 through the wall of the housing 120 through which a thermoplastic elastomer flows when injected to form molded member 140. Molded member 140 preferably comprises two side panels 144 that reside in corresponding cavities 122 on opposite sides of housing 120 to serve as gripping surfaces 142 of flashlight 110 and an actuator button 146 that resides in the rear end of housing 120 that serves to actuate a switch function, all of which is molded contemporaneously as one piece into the housing 120. Elastomeric material forming molded member 140 is preferably injected at cylindrical opening 121 at the rear end of housing 120 to form actuator button 146 and flows through passages or openings 124 into cavities 122 to form grip 142. Grip 142 preferably includes raised features such as bumps 145 to facilitate a surer grip and/or to enhance the appearance of flashlight 110.

Preferably, housing 120 is an injection molded piece and molded member 140 is injection molded therein. Further, a two-step injection molding process is preferably utilized to form housing 120 and to mold molded member 140 therein, and preferably on a single molding machine known as a "two-step" or "two-shot" molding machine, in like manner to that described above in relation to flashlight 10, housing 20 and molded member 40. In flashlight 110, housing 120, molded member 140 and head 160 are formed of the same materials as are utilized for the corresponding items of flashlight 10, and it is preferred that U-shaped elongated actuator 180, bulb holder 188 and contact module 194 be molded of an electrically insulating material such as CAPRON® and NYPEL® nylons available from Allied Signal, Inc., Engineering Plastics, but may be made of, for example, other types of nylon, or of polypropylene, polycarbonate, polyester-polycarbonate blends and ABS polycarbonate blends, or other suitable insulating material.

Preferably, where a flashlight employs a battery having three or more separate battery packages, such as plural AA-size, C-size or D-size cells, the contacts employed to make contact therewith are arranged to preclude connection of any one or more of the cells in circuit in a reverse polarity sense, even if such cell were to be physically installed backwards. Most cylindrical batteries such as AA, C and D-size cells have at one end thereof a smaller diameter button terminal for the positive terminal and at the other end thereof a larger diameter relatively flat circular terminal for the negative terminal. To prevent reverse polarity connection, contacts for making contact with the lesser diameter positive terminal of each battery cell are preferably of smaller diameter than that of the battery positive terminal, and may be surrounded in whole or in part by one or more raised insulating projections into which the battery positive terminal, but not the battery negative terminal, fits. In addition, contacts making contact with the larger diameter negative terminals of each battery cell are preferably annular and of larger inner diameter than the diameter of the battery positive terminal, and may be surrounded in whole or in part by one or more raised insulating projections to center the battery cell with respect to the annular contact.

It will be recognized by those skilled in the art that changes or modifications may be made to the above-described embodiments without departing from the broad inventive concept of the invention. It should therefore be understood that this invention is not limited to the particular embodiments described herein, but is intended to include all changes and modifications that are within the scope and spirit of the invention as set forth in the following claims.

For example, the actuator button 46, 146 could be located on the side of the housing 20, 120 instead of at the rear 14, 114 of the housing 20, 120 to activate the flashlight 10, 110 in a momentary switch manner. Further, elongated actuator 80, 180 need not be "U"-shaped, but may be any convenient shape, such as an "L", "T" or "Z" shape, for communicating actuation of actuator button 46, 146 to at least one of the switch contacts. Elongated actuator may also have any convenient cross-sectional shape, and need not be rectangular or cruciform-like in cross-section as illustrated.

Limiting of the travel of elongated actuator 80, 180 as provided by exemplary outwardly extending arms 84, 184 of actuator 80, 180 engaging slots 32, 132 of housing 20, 120, respectively, may be provided alternatively by other cooperating engaging features such as raised engaging feature (e.g., a tab, pin or bump) on one of housing 20, 120 and actuator 80, 180 and a recessed engaging feature (e.g., a hole, slot or recess) on the other one of housing 20, 120 and actuator 80, 180. Moreover, such cooperating engaging features need not be near the head end of housing 20, 120, but may be located at any convenient location where housing 20, 120 and actuator 80, 180 are proximate each other.

Further, spring 96 could be located rearward of batteries 86 in flashlight 10 so that depressing of actuator button 46 moves elongated actuator 80 and compresses spring 96, but does not move batteries 86. Similarly, contacts similar to those provided by spring 196 and contact holder 194 could be located rearward of batteries 186 for making and breaking an electrical connection between the rearward terminals of the rearmost batteries 186.

Additionally, the momentary switch action could be replaced by a toggle switch action that the user would have to push the actuator button 46 once to turn the flashlight 10 on and push it again to turn the flashlight 10 off. Alternatively, actuator button 46 bonded into the opening 21 in housing 20 could be a simple diaphragm through which is actuated, either directly or indirectly by moving an actuator member, a push-button or other switch. Further, the continuous switch action could be activated by a rotatable switch actuated by rotating an end cap on the tail end of flashlight 10 relative to the housing 20 instead of rotating the head 60 of the flashlight 10. Further still, molded member 40 could be molded completely around the wall 26, 126 of housing 20, 120 instead of just in portions of wall 26, 126 thereof.

What is claimed is:

1. A flashlight housing comprising:

a housing having a front end, a rear end, a wall and a cavity; and a molded member molded into the cavity of the housing to provide a gripping surface and an actuator for operating a switch, wherein the gripping surface and the actuator are molded into the housing as one piece.

2. The flashlight housing of claim 1 wherein the housing has the cavity in the wall thereof and has an opening in which the actuator is formed, the housing also having at least one fluid passage in fluid communication with the cavity and the actuator opening for allowing elastomer to be injected into the housing and flow into the cavity, the actuator opening and the fluid passage of the housing to form the molded member therein.

3. The flashlight housing of claim 2 wherein the gripping surface is formed of elastomer molded into the cavity in the wall of the housing and the actuator is formed of elastomer molded into the actuator opening of the housing.

4. The flashlight housing of claim 2 wherein the fluid passage is at least in part on an inside surface of the housing and has at least one passage through the wall of the housing for allowing elastomer to fill the cavity to form the gripping surface on an outside surface of the housing and the actuator at the rear end of the housing.

5. The flashlight housing of claim 1 wherein the molded member is formed of a material that molecularly bonds to the housing.

6. The flashlight housing of claim 1 wherein the housing includes at least one raised indicia adjacent to which the molded member is molded and having an end, so that the end of the raised indicia of the housing is visible after the molded member is molded into the housing.

7. The flashlight housing of claim 1 wherein the housing is formed of a thermoplastic material.

8. The flashlight housing of claim 7 wherein the molded member is formed of a thermoplastic elastomer.

9. The flashlight housing of claim 8 wherein the thermoplastic elastomer is selected for molecular bonding to the housing thermoplastic material.

10. The flashlight housing of claim 1 in combination with a bulb, a switch and an electrical circuit connecting the bulb and the switch in circuit with at least one terminal to which a battery may be connected.

11. The flashlight housing of claim 10 wherein the actuator operates the switch.

12. A flashlight adapted for use with a battery comprising:

a housing having a front end and a rear end and an opening in a wall of the housing in fluid communication with a cavity in an outer surface of the housing;

a bulb and a switch connected in circuit in said housing;

a grip molded into the cavity of the housing for providing a gripping surface;

an actuator molded into the opening of the housing for operating the switch;

wherein the grip and the actuator are molded contemporaneously as one piece for sealing the opening of the housing.

13. The flashlight of claim 12 further comprising an actuator member coupled between the actuator and the switch, wherein the actuator member and the housing include respective cooperating engaging features to limit the travel of the actuator member relative to the housing.

14. The flashlight of claim 13 wherein the cooperating engaging features include one of the housing and the actuator member having a hole and the other of the housing and the actuator member having a projection extending into the hole.

15. A flashlight comprising:

a housing member having an opening therethrough;

a bulb, a battery and a switch connected in circuit in said housing;

an actuator molded into the opening in the housing for operating the switch;

wherein the actuator is molded of a material that bonds to the housing member for sealing the opening in the housing member of the flashlight.

16. The flashlight of claim 15 wherein the actuator is located at an end of the housing.

17. The flashlight of claim 15 wherein the actuator operates a momentary switch.

18. The flashlight of claim 17 wherein said momentary switch includes first and second contacts, said first contact being responsive to said actuator to move within a limited range of movement to contact said second contact.

19. The flashlight of claim 18 wherein said second contact is movable independently of said first contact to move to a position beyond the limited range of movement of said first contact to preclude contact therewith responsive to said actuator.

20. The flashlight of claim 15 wherein said switch includes first and second contacts, wherein at least one of said first and second contacts is movable independently of the other of said first and second contacts to make contact therewith irrespective of said actuator.

21. A method of producing a flashlight housing comprising:

obtaining a housing having a grip cavity on the outside thereof and having an actuator opening;

placing a core inside the housing;

placing a mold on the housing, wherein the core and the mold define a mold volume around the housing;

injecting elastomer into the mold until elastomer fills the mold volume including the actuator opening and the grip cavity, whereby the elastomer forms a grip and an actuator molded into the housing; and removing the core and the mold.

22. The method of claim 21 wherein obtaining a housing includes:

closing a housing mold including a second core and an outer mold defining the housing having a grip cavity on the outside thereof and having an actuator opening;

injecting thermoplastic material to fill the housing mold; and removing the molded housing from the housing mold.

23. The method of claim 22 wherein the method is performed on one two-shot molding machine.

24. The method of claim 21 wherein injecting elastomer comprises injecting thermoplastic elastomer.

25. The method of claim 24 further comprising cooling the thermoplastic elastomer until it solidifies to form the grip and actuator molded as one piece to the housing.

26. The method of claim 21 wherein the actuator opening is at a rear end of the housing, and wherein injecting elastomer comprises injecting thermoplastic elastomer at a rear end of the housing.

27. A flashlight comprising:

a housing having a front end, a rear end, and a wall having a cavity, and adapted for containing at least one battery;

a head attached at the front end of the housing, the head including a reflector and a bulb positioned in said reflector;

an electrical switch;

an electrical circuit connecting the bulb and the switch in circuit with the at least one battery;

a molded member molded into the cavity of the housing to provide a gripping surface on the wall thereof and an actuator for operating the switch, wherein the gripping surface and the actuator are contemporaneously molded into the housing as one piece.

28. A flashlight comprising:

a housing adapted to hold a battery;

a bulb and a switch connected in circuit in the housing;

an actuator in the housing and movable for operating the switch;

wherein the actuator and the housing include respective cooperating engaging features within the housing to limit the travel of the actuator relative to the housing.

29. The flashlight of claim 28 wherein the actuator comprises an actuator button and an actuator member within the housing coupling the actuator button and the switch.

30. The flashlight of claim 28 wherein the cooperating engaging features include one of the housing and the actuator having a hole and the other of the housing and the actuator member having a projection extending into the hole.

31. The flashlight of claim 30 wherein the hole is a slot in the housing and wherein the projection is an arm extending outwardly of the actuator.

32. The flashlight of claim 28 wherein the actuator is formed of an electrically conductive material and is connected in circuit with the bulb and the switch.

33. A flashlight comprising:

a housing having a head end and a tail end, and adapted for containing at least one battery;

a head attached at the head end of the housing, the head including a bulb;

an electrical switch having first and second switch contacts;

an electrical circuit connecting the bulb and the electrical switch in circuit with the at least one battery;

an actuator in the housing operably connected to move the first switch contact within a limited distance to come into and out of contact with the second switch contact; and means for moving the one of the first and second switch contacts independently of the other of the first and second switch contacts to be in continuous contact therewith and for moving one of the first and second switch contacts beyond the limited distance over which the other of the first and second switch contacts is movable to be in continuous non-contact therewith.

34. The flashlight of claim 33 wherein said housing further includes a gripping surface, wherein the gripping surface and the actuator are contemporaneously molded into the housing as one piece.

35. The flashlight of claim 33 further including an elongated member operably coupling the actuator to the first switch contact, the elongated member having a first engaging feature and the housing having a second engaging feature engaging the first engaging feature, wherein the engagement of the first and second engaging features define the limited distance.

36. The flashlight of claim 35 wherein the second engaging feature includes the housing having a slot of given length and the first engaging feature includes an arm engaging the slot, the given length defining the limited distance.

37. The flashlight of claim 33 wherein the actuator comprises an elongated metal member providing the first switch contact and having an arm extending outwardly, wherein the housing has a slot of given length, the outwardly extending arm engaging the slot of given length to define the limited distance.

38. The flashlight of claim 33 further including an elongated member operably coupling the actuator to the first switch contact, the elongated member being in the housing and movable the limited distance with respect thereto.

39. The flashlight of claim 33 wherein the head includes the second switch contact and is movable with respect to the housing a distance greater than the limited distance.

40. The flashlight of claim 39 wherein the second switch contact contacts the first switch contact when the head is moved towards the tail end of the housing, and wherein the second contact and the first contact do not contact when the head is moved away from the tail end of the housing the distance greater than the limited distance.

41. The flashlight of claim 33 further including a battery, wherein the actuator is operably coupled to the second switch contact by the battery.

42. The flashlight of claim 33 wherein the actuator includes a button in the tail end of the housing.

43. A flashlight adapted for use with a battery comprising:

a housing having a front end and a rear end, having an opening in a wall of the housing and a cavity in an outer surface of the housing;

a bulb and a switch connected in circuit in said housing;

a grip molded into the cavity of the housing for providing a gripping surface;

an actuator molded into the opening of the housing for operating the switch and for sealing the opening of the housing.

44. A flashlight housing comprising:

a housing having a front end, a rear end, a wall and a cavity; and a molded member molded into the cavity of the housing to provide a gripping surface and an actuator for operating a switch, wherein the gripping surface and the actuator are molded into the housing substantially contemporaneously.

* * * * *